US008869318B2

(12) United States Patent
Tanguay

(10) Patent No.: US 8,869,318 B2
(45) Date of Patent: Oct. 28, 2014

(54) BEDPAN HAVING A HANDLE DEFINED THEREIN

(75) Inventor: Eric Tanguay, Candiac (CA)

(73) Assignee: Hygie Canada Inc., Brossard (CA)

( * ) Notice: Subject to any disclaimer, the term of this patent is extended or adjusted under 35 U.S.C. 154(b) by 848 days.

(21) Appl. No.: 12/747,417

(22) PCT Filed: Dec. 11, 2008

(86) PCT No.: PCT/CA2008/002202

§ 371 (c)(1),
(2), (4) Date: Jun. 10, 2010

(87) PCT Pub. No.: WO2009/073983

PCT Pub. Date: Jun. 18, 2009

(65) Prior Publication Data

US 2010/0263118 A1 Oct. 21, 2010

Related U.S. Application Data

(60) Provisional application No. 60/996,951, filed on Dec. 12, 2007.

(51) Int. Cl.
*A61G 9/00* (2006.01)

(52) U.S. Cl.
CPC ..... *A61G 9/003* (2013.01)
USPC ..... 4/452

(58) Field of Classification Search
CPC ..... A61G 9/003
USPC ..... 4/450–457
See application file for complete search history.

(56) References Cited

U.S. PATENT DOCUMENTS

| | | | | |
|---|---|---|---|---|
| D216,058 | S | 11/1969 | Painter et al. | |
| D235,081 | S | 5/1975 | Gatewood | |
| 3,921,234 | A | 11/1975 | Mracek et al. | |
| 4,011,606 | A * | 3/1977 | Scrafield et al. | 4/457 |
| D249,162 | S | 8/1978 | Mills | |
| D253,304 | S | 10/1979 | Nakao et al. | |
| D270,018 | S | 8/1983 | Knight | |

(Continued)

FOREIGN PATENT DOCUMENTS

| | | |
|---|---|---|
| EP | 0031396 | 7/1981 |
| EP | 0948304 | 4/2005 |

(Continued)

*Primary Examiner* — Lori Baker
(74) *Attorney, Agent, or Firm* — Price Henevel LLP

(57) ABSTRACT

A bedpan comprises a body member defining a reservoir, the reservoir being shaped and dimensioned for receiving bodily waste, the body member including a receptacle portion shaped for receiving therein a bedpan liner and an open support section including a central opening providing access to the reservoir defined by the body member. The support section is defined by a peripheral wall extending downwardly from a peripheral edge of the central opening into the reservoir. A bottom wall may or may not be provided at a bottom of the peripheral wall. If it is provided, it is defined at a downward edge of the peripheral wall opposite to the central opening to close a bottom of the reservoir. At least one handle is provided for insertion and removal of the bedpan under a patient's buttocks, the handle including an opening extending through at least one of the bottom wall (if present) and the peripheral wall. The central opening of the reservoir is covered by the bedpan liner when the liner is received by the receptacle portion.

19 Claims, 9 Drawing Sheets

(56) References Cited

U.S. PATENT DOCUMENTS

| | | | | | |
|---|---|---|---|---|---|
| 4,437,195 | A | * | 3/1984 | Mangels | 4/456 |
| 4,610,039 | A | * | 9/1986 | Stern | 4/285 |
| D304,496 | S | * | 11/1989 | Thomas | D24/117 |
| D341,421 | S | | 11/1993 | Jones | |
| D353,000 | S | | 11/1994 | Bradley, Jr. | |
| 5,455,972 | A | * | 10/1995 | Williams | 4/452 |
| 5,778,461 | A | | 7/1998 | Attaway | |
| D405,526 | S | | 2/1999 | Bonelli | |
| D437,053 | S | | 1/2001 | Mirabal, Jr. | |
| D446,845 | S | | 8/2001 | Jacuzzi et al. | |
| D482,446 | S | | 11/2003 | Rainville-Lonn et al. | |
| D495,415 | S | | 8/2004 | Theodore | |
| D571,460 | S | * | 6/2008 | Korjack | D24/123 |
| D579,558 | S | | 10/2008 | McBarnett et al. | |
| D615,193 | S | * | 5/2010 | Utz | D24/123 |
| D627,062 | S | * | 11/2010 | Tanguay | D24/123 |
| 8,192,411 | B2 | * | 6/2012 | Lund et al. | 604/334 |

FOREIGN PATENT DOCUMENTS

| | | |
|---|---|---|
| FR | 2778842 | 11/1999 |
| JP | HEI07001918 | 1/1995 |
| WO | 03090659 | 11/2003 |
| WO | 2009073983 | 6/2009 |

* cited by examiner

BEDPAN HAVING A HANDLE DEFINED THEREIN

CROSS-REFERENCE TO RELATED APPLICATIONS

This application claims priority of U.S. provisional patent application No. 60/996,951 filed on Dec. 12, 2007 by Applicant, the specifications of which are hereby incorporated by reference. This application is a national phase of PCT patent application serial number PCT/CA2008/002202 filed Dec. 11, 2008, designating the United States of America, now pending, the specification of which is hereby incorporated by reference.

FIELD OF THE INVENTION

The invention relates to bedpans, and particularly to bedpans having prehension features.

DESCRIPTION OF THE PRIOR ART

Bedpans, as toileting facilities, usually consist of a metal, glass, or plastic receptacle for collecting urinary and fecal discharge. It is typically used in the case of persons confined to a bed or a wheelchair.

Either the patient himself or the nursing staff inserts the bedpan under the patient's buttocks and withdraws it once it contains urinary and/or fecal discharge. Depending on the patient's position, the bedpan is inserted and removed forwardly, rearwardly or laterally relative to the patient, while trying to prevent spillage of its contents.

The outer surface of the bedpan is typically relatively smooth and bedpan prehension is not easy, especially if the patient needs to be helped to lift his buttocks.

The nursing staff removes the bedpan located beneath the patient's buttocks, transports it to an appropriate area to get rid of its contents, disinfects and possibly sterilizes the bedpan for reuse. The nursing staff is required to exercise special vigilance to avoid contact with these unsanitary substances. In addition, the handling steps required (transportation, drainage, washing, rinsing, disinfection, sterilization) are considerably important and tedious.

BRIEF SUMMARY OF THE INVENTION

It is therefore an aim of the present invention to address at least one of the above mentioned difficulties.

According to a general aspect, there is provided a bedpan which comprises a body member defining a reservoir, the reservoir being shaped and dimensioned for receiving bodily waste, the body member including a receptacle portion shaped for receiving therein a bedpan liner and an open support section including a central opening providing access to the reservoir defined by the body member. The support section is defined by a peripheral wall extending downwardly from a peripheral edge of the central opening into the reservoir. A bottom wall may or may not be provided at a bottom of the peripheral wall. If it is provided, it is defined at a downward edge of the peripheral wall opposite to the central opening to close a bottom of the reservoir. At least one handle is provided for insertion and removal of the bedpan under a patient's buttocks, the handle including an opening extending through at least one of the bottom wall (if present) and the peripheral wall. The central opening of the reservoir is covered by the bedpan liner when the liner is received by the receptacle portion.

According to a first aspect of the invention, there is provided a bedpan comprising a body member defining a reservoir, the reservoir being shaped and dimensioned for receiving bodily waste, the body member including a receptacle portion shaped for receiving therein a bedpan liner and an open support section including a central opening providing access to the reservoir defined by the body member, the support section being defined by a peripheral wall extending downwardly from a peripheral edge of the central opening into the reservoir, and at least one peripheral handle for insertion and removal of the bedpan under a patient's buttocks, the peripheral handle including an opening extending through the peripheral wall, wherein the central opening of the reservoir is covered by the bedpan liner when the liner is received by the receptacle portion.

A bottom wall can also be provided at a bottom of the peripheral wall and is defined at a downward edge of the peripheral wall opposite to the central opening to close a bottom of the reservoir. At least one bottom handle can also be provided for insertion and removal of the bedpan under a patient's buttocks, the bottom handle including an opening extending through the bottom wall. The at least one peripheral handle can be one peripheral handle and the at least one bottom handle is three bottom handles.

In an embodiment, the at least one handle is one handle and the opening is an opening extending through the bottom wall.

In an embodiment, the at least one handle is three handles, each handle including an opening extending through the bottom wall.

In an embodiment, the at least one handle is two handles, each handle including an opening extending through the peripheral wall.

In an embodiment, the at least one handle is five handles, three ones of the five handles including an opening extending through the bottom wall and two other ones of the five handles including an opening extending through the peripheral wall. The two handles can be partially facing one another on the peripheral wall, near a rear of the bedpan.

According to a third aspect of the invention, there is provided a bottomless bedpan in combination with a bedpan liner, the bottomless bedpan comprising a cylinder including a peripheral wall member, wherein the peripheral wall member is configured to define a cylinder edge for receiving the bedpan liner capable of holding human waste; and at least one handle for insertion and removal of the bedpan under a patient's buttocks, the handle including a through hole extending through the peripheral wall member.

In an embodiment, the through hole is a through hole extending through the bottom wall member.

In an embodiment, the through hole is a through hole extending through the peripheral wall member.

According to a fifth aspect of the invention, there is provided a bedpan kit comprising a bedpan liner capable of holding human waste; a cylinder including a peripheral wall member, wherein the peripheral wall member is configured to define a top cylinder edge for receiving the bedpan liner and at least one apertured handle extending through the peripheral wall member for insertion and removal of the bedpan under a patient's buttocks; wherein the bedpan liner is insertable in the cylinder and at least partially lines the peripheral wall member, thereby covering the apertured handle and holding the human waste received therein within the cylinder and the liner.

In an embodiment, the cylinder has a bottom wall defined at a bottom cylinder edge for closing the cylinder into a reservoir.

According to a sixth aspect of the invention, there is provided a bedpan kit comprising a rigid open top pan having a bottom wall and a surrounding peripheral wall, the bottom wall and the surrounding peripheral wall defining a cavity in the open top pan, at least one of the bottom wall and the surrounding peripheral wall including at least one apertured handle for insertion and removal of the vessel under a patient's buttocks; and a bedpan liner insertable in the cavity, at least partially lining the bottom wall and the surrounding peripheral wall and covering the at least one apertured handle for holding human waste received therein.

In an embodiment, the apertured handle is a through hole extending through the bottom wall.

In an embodiment, the apertured handle is a through hole extending through the peripheral wall.

In an embodiment, the at least one apertured handle is four apertured handles, three ones of the four apertured handles including a through hole extending through the bottom wall and one other one of the four apertured handles including a through hole extending through the peripheral wall.

In an embodiment, the bedpan liner comprises a layer of a flexible and impermeable material.

In an embodiment, the bedpan liner comprises an absorbent material layer.

In an embodiment, the absorbent material layer comprises a gel agent in one of a powder crystal and a fiber form.

In an embodiment, the liner comprises a bag.

In an embodiment, the liner comprises a bag and the absorbent material layer is one of spread out over the bag, placed on the bag and affixed to the bag.

In an embodiment, the bedpan liner is disposable, i.e. it is a disposable bedpan liner.

BRIEF DESCRIPTION OF THE DRAWINGS

Having thus generally described the nature of the invention, reference will now be made to the accompanying drawings, showing by way of illustration a preferred embodiment thereof and in which.

It will be noted that throughout the appended drawings, like features are identified by like reference numerals.

DETAILED DESCRIPTION

Figure 1:
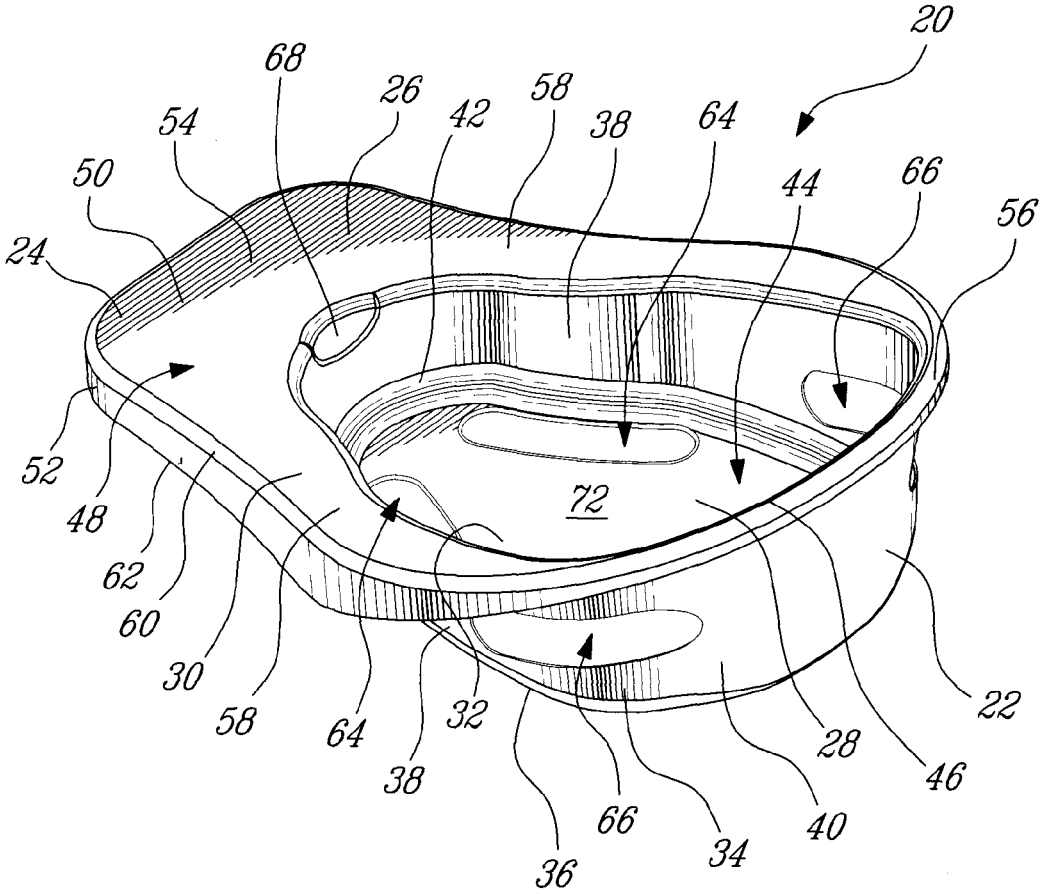
FIG. 1 is a perspective view of a bedpan having apertured handles in accordance with an embodiment.
Figure 2:
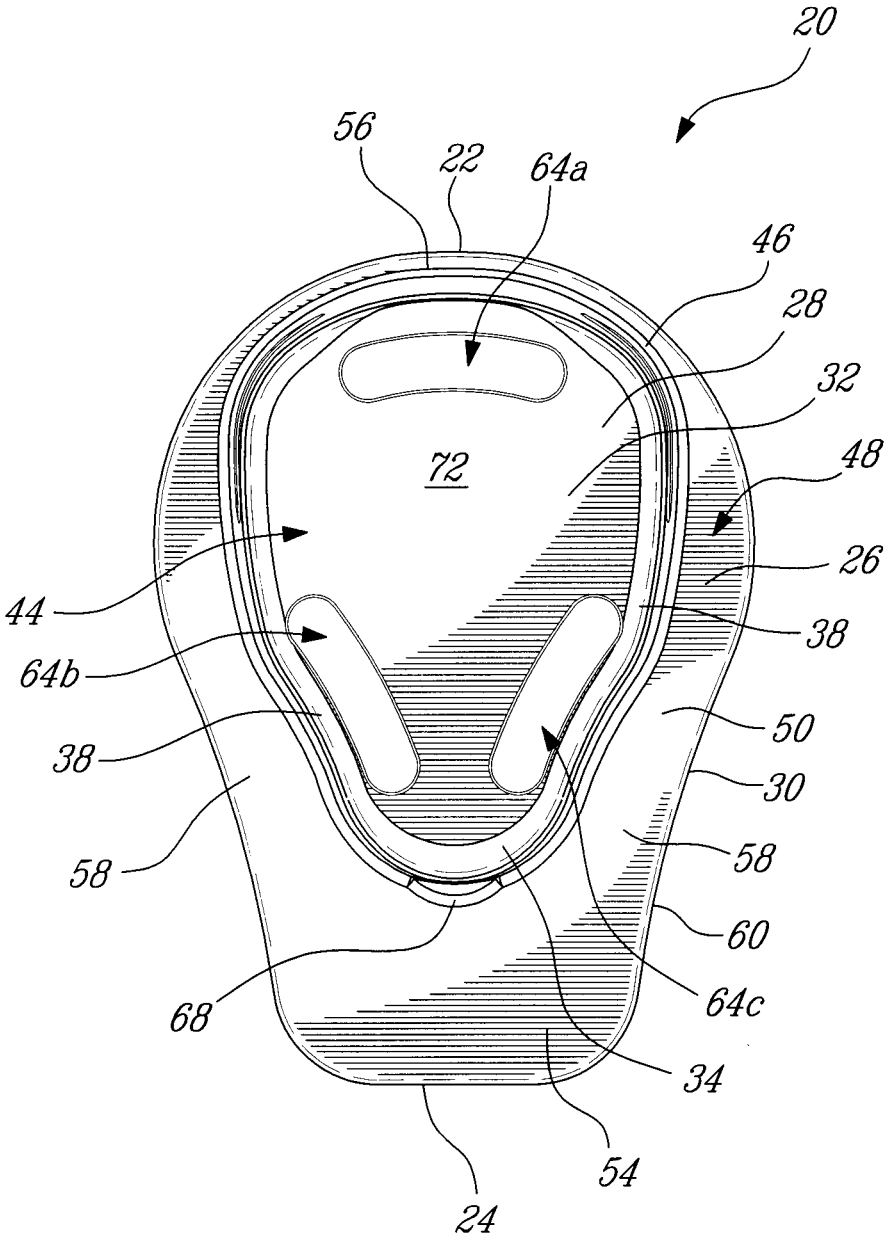
FIG. 2 is a top plan view of the bedpan shown in FIG. 1.
Figure 3:
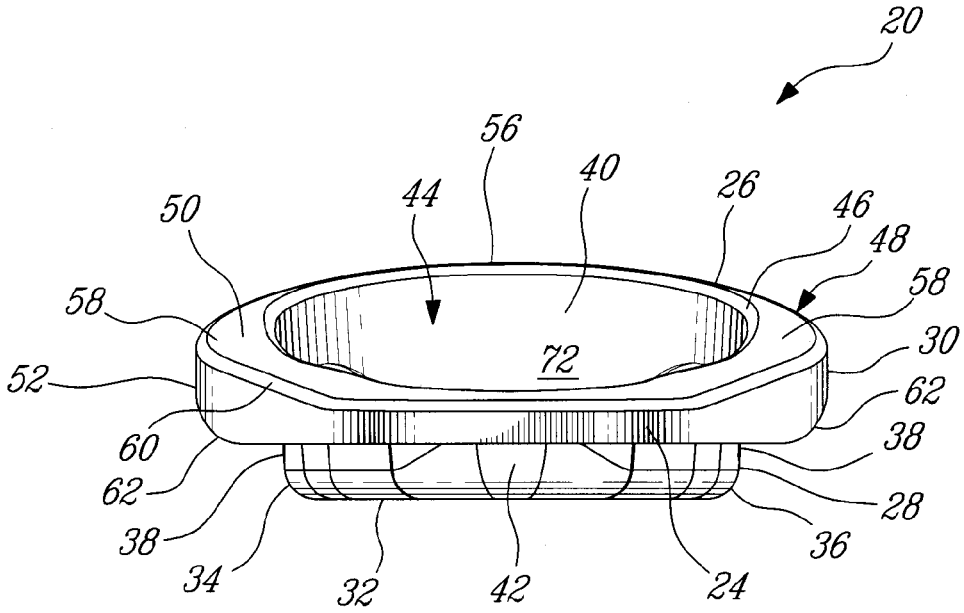
FIG. 3 is a front elevation view of the bedpan shown in FIG. 1.
Figure 4:
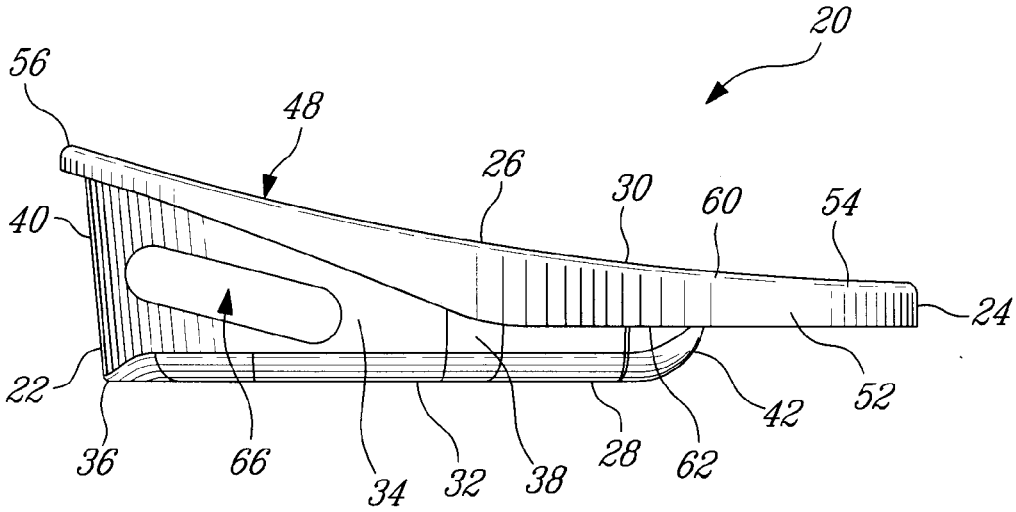
FIG. 4 is side elevation view of the bedpan shown in FIG. 1.

Now, with reference to the drawings and, more particularly, to FIGS. 1 to 4, it will be seen that the bedpan 20 is of a generally oval shape in top plan view, including a rearward end 22 and a narrower, more tapered forward end 24.

The bedpan 20 has a body member 26 in the shape of an open top pan. The body member 26 has a receptacle portion 28 (or vessel) and a seat member 30 (or open support section) extending outwardly of the receptacle portion 28. The receptacle portion 28 is defined by a generally planar bottom wall 32 and an upright peripheral wall 34 extending up from the peripheral edge 36 of the bottom wall 32. The upright wall 34 can be described as having a pair of opposed sidewall segments 38, and opposed end wall segments including a rear end wall segment 40 and a front end wall segment 42, shorter than the rear end wall segment 40. The sidewall segments 38 taper downwardly from the rear end wall segment 40 to the front end wall segment 42, the bottom wall 32 being generally planar. The various wall segments 38, 40, 42 blend together to define the generally continuous upright peripheral wall 34.

The bottom wall 32 and the upright peripheral wall 34 define together a cavity or a reservoir 44 shaped and dimensioned for receiving bodily waste, as will be described in more detail below.

Extending outwardly and perpendicularly from the upper peripheral edge 46 of the upright peripheral wall 34 is a seat member 30. The seat member 30 includes a flange 48 with a horizontally extending section 50 and a downwardly extending section 52.

The horizontally extending section 50 of the flange 48 has a forward 54 and a rearward 56 segment, the rearward segment 56 being wider than the forward segment 54. The rearward segment 56 is not very thick. The forward segment 54 is thicker than the rearward segment 56 and forms a plate. Sidewall segments 58 extend between the forward and the rearward segments 54, 56. The sidewall segments 58 taper in width from the forward segment 54 to the rearward segment 56 thereby creating a keyhole oval shape to the bedpan 20.

Although the front of the bedpan 20 is identified as being a forward end 24 and the back of the bedpan 20 is identified as being a rearward end 22, it will be noted that, in use, the front of the bedpan 20 is at the back of the patient and the back of the bedpan 20 is at the front of the patient.

Indeed, in order to insert the bedpan 20 under the patient's buttocks while the patient is lying on his back in bed, the bedpan 20 is grasped by the service provider at the rearward segment 56, and optionally using one of the handles. The service provider then places the bedpan 20 between the legs of the patient, the forward end 24 closest to the patient's buttocks and the rearward end 22 closest to the patient's feet. The bedpan 20 is then pushed towards the patient's buttocks and the plate of the forward segment 54 reaches the buttocks first. The pressure exerted by the service provider on the rearward segment 56 towards the patient, and the patient's own strength, if any, to pull up and lift his buttocks with his shoulders resting on the bed, allows the plate of the forward segment 54 to lift the buttocks and slide under.

Once placed for use by a patient under his buttocks, the plate of the horizontally extending section 50 of the flange 48 receives the back and the top of the buttocks of the patient, the reservoir 44 is aligned with the body orifices to receive the human waste and the legs of the patient are stretched along the tapered sidewall segments 58 of the bedpan 20 from the reservoir towards the rearward end 22, the feet of the patient being located at a distance from the rearward end 22.

If the patient is lying on his side when the bedpan 20 is to be placed underneath his buttocks, the forward segment 24 will still be placed at the patient's back and the rearward segment 22 will be placed at his thighs using the handles and the flange. The patient will then simply be turned on his back to use the bedpan 20.

The downwardly extending section 52 of the flange 48 extends generally downwardly from the outer peripheral edge 60 of the horizontally extending section 50 and is spaced from the upright peripheral wall 34. The downwardly extending section 52 at the rearward end 22 of the bedpan 20 enlarges as it extends forwardly. The bottom edge 62 of the downwardly extending section 52 terminates somewhat above the plane of the pan bottom wall 32. As a result it is possible for an attendant to get his fingers under the flange 48 and utilize the same as a handle when withdrawing the bedpan 20 laterally from beneath a patient.

Through holes 64, 66 extend through the bottom wall 32 and the peripheral wall 34 of the receptacle portion 28 respectively. The through holes 64, 66 are apertured handles which facilitate the insertion of the bedpan 20 under and the withdrawal from a patient's buttocks. The apertured handles 64, 66 have rounded peripheral edges to increase the bedpan prehension properties.

In the embodiment shown in FIGS. 1-4, the bottom wall 32 includes three apertured handles 64*a*, 64*b*, 64*c*, one 64*a* substantially parallel and proximate to the rearward end 22 and two 64*b* and 64*c* substantially parallel to a respective sidewall segment 38 and proximate to the forward end 24. It is appreciated that in alternate embodiments, the bottom wall 32 can include more or less apertured handles 64 and that the location of the apertured handles 64 can differ. An attendant can use the rearward end apertured handle 64*a* to insert or withdraw the bedpan 20 rearwardly of a patient. Similarly, the attendant can use a respective lateral apertured handle 64*b*, 64*c* to insert and withdraw the bedpan 20 laterally or forwardly of the patient.

Similarly, in the embodiment shown in FIGS. 1-4, the peripheral wall 34 includes two apertured handles 66, which are located proximate to the rearward end 22, on a respective sidewall segment 38. It is appreciated that in alternate embodiments, the peripheral wall 34 can include more or less apertured handles 66 and that the location of the apertured handles 66 can differ. The attendant can use a respective sidewall apertured handle 66 to insert and withdraw the bedpan 20 laterally of the patient.

It is appreciated that the shape of both the bottom and peripheral wall apertured handles 64, 66 can differ from the one shown in reference to FIGS. 1-4.

Figure 5:
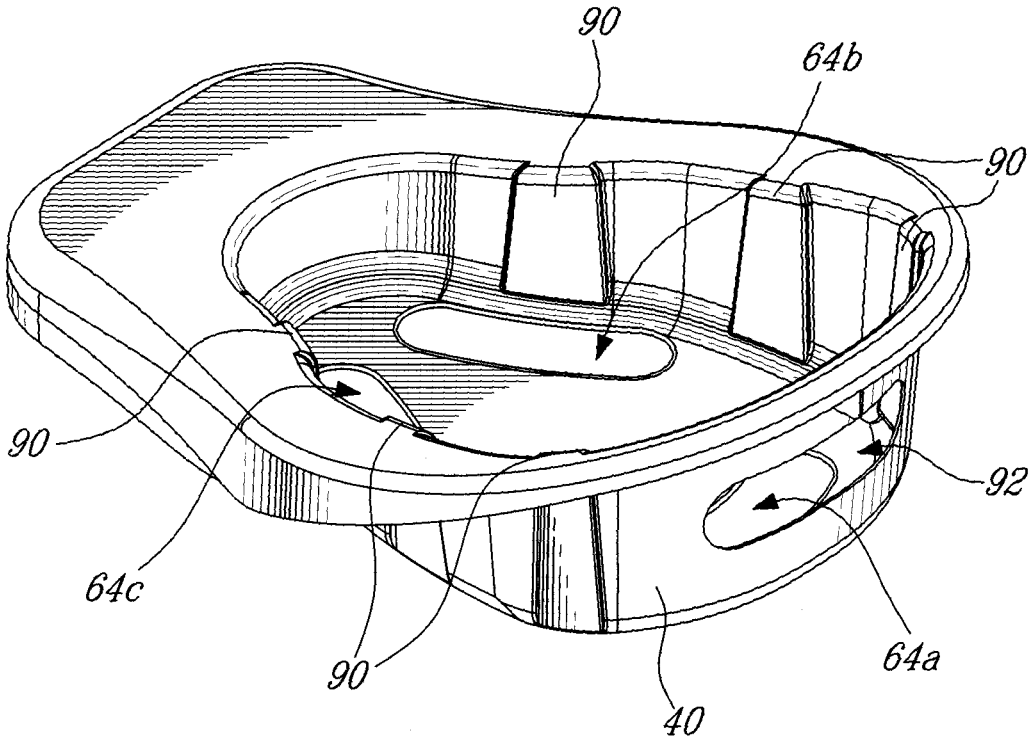
FIG. 5 is a perspective top view of another bedpan having apertured handles in accordance with another embodiment.
Figure 6:
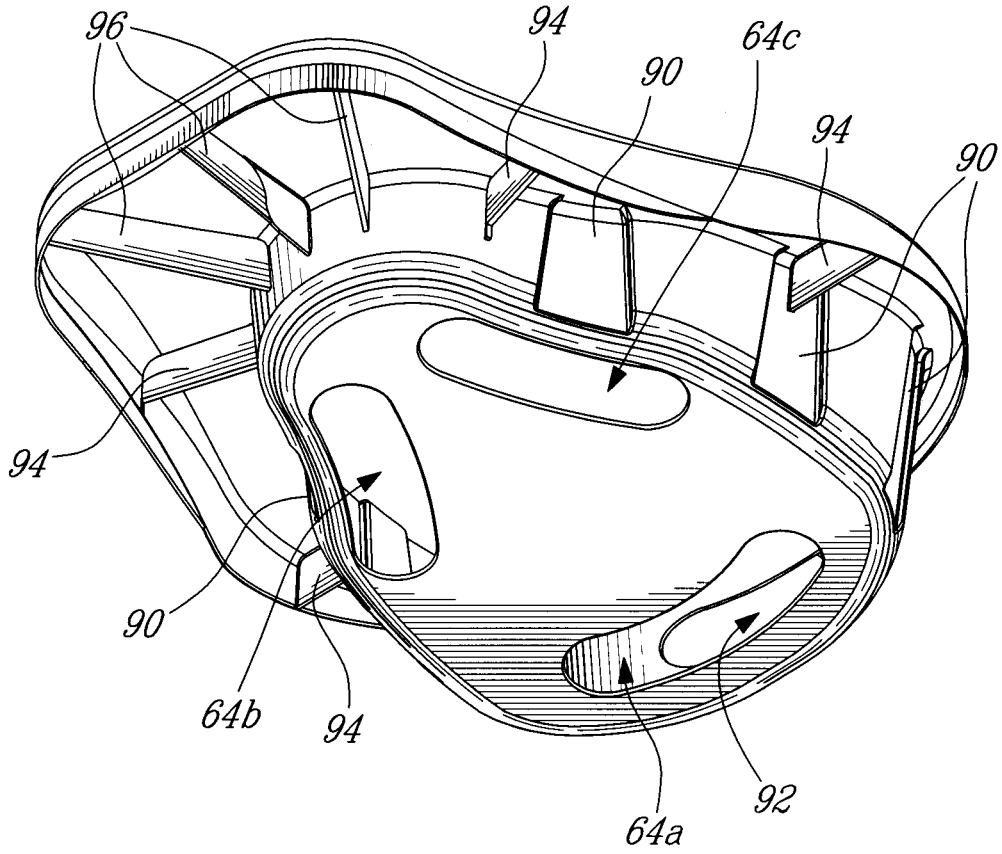
FIG. 6 is a perspective bottom view of the bedpan of FIG. 5.

With reference to FIG. 5 and FIG. 6, another embodiment of the bedpan 20 is shown. In this embodiment, the insertion aperture 68 is absent, reinforcement ribs 94, 96 were added to increase the bedpan rigidity, side handles 66 were removed and a rear handle 92 was added on rear end wall 40. Inward protuberances 90 also add to the solidity and comfort of the bedpan 20.

In this embodiment, six inward protuberances 90 are provided but any number could be used, of many different sizes and shapes in any different locations. Four side ribs 94 and three front ribs 96 are provided but their number, shape, size and location could also differ.

In this embodiment, the rear handle 92 is provided on the rear end wall 40 and no other peripheral wall through holes 66 are provided. As will be readily understood, any number of handles could be provided as long as stability and rigidity of the bedpan 20 is preserved. The downwardly extending section 52 of the flange 48 of the seat member 30 is also larger than in the embodiment of FIG. 1 to help prevent spills of the contents when the bedpan is rocked in use or during removal from under the patient's buttocks. It acts as a stop to prevent complete rotation of the bedpan and displacement of the liquids from the receptacle to the forward end, over the flange to the bed on which the patient is located.

The bedpan 20 can be made of several materials such as metal, glass, or polymers. For instance, polyethylene or polypropylene, molded in any desired color, can be used.

The bedpan 20 having at least one apertured handle 64, 66 provides a new and improved bedpan structure designed particularly for use by attendants for facilitating bedpan insertion and removal. In combination with the bedpan liner 70, it reduces the time-consuming and difficult handling steps.

The apertured handles 64, 66 provided in at least one of the sidewall 34 and the bottom wall 32 facilitate the insertion and withdrawal of the bedpan 20 from beneath a patient.

The bedpan 20 is thus relatively lightweight, comfortable, and can be easily handled.

In an embodiment, the upright wall 34 can taper inwardly from the upper edge 46 to the lower edge 36 relative to the cavity 44 and the downwardly extending section 52 of the flange 48 taper outwardly from the upper edge 60 to the lower edge 62 relative to the cavity 44. The resulting bedpan 20 can thus be nested within another. Consequently, valuable space is saved when storing or shipping a plurality of bedpans 20.

In an embodiment, the bedpan 20 has a width ranging between 9 and 13 inches, a length ranging between 14 and 17 inches and a height ranging between 2.5 and 5 inches. In an alternate embodiment, the bedpan 20 has a width ranging between 11 and 12 inches, a length ranging between 15 and 16 inches and a height ranging between 3.75 and 4.4 inches.

In an embodiment, the cavity 44 has a width ranging between 7 and 9.5 inches and, in an alternate embodiment, the cavity width is between 8 and 9 inches.

In an embodiment, the height of the upright peripheral wall 34 between the peripheral edge 36 and the bottom edge 62 is between 0.8 and 1.2 inches and, in an alternate embodiment, it is between 0.9 and 1.1 inches.

In an embodiment, the height of the downwardly extending section 52 of the flange 48 in the forward end 24 is between 0.5 and 1 inch.

In an embodiment, the width and the length of the apertured handles 64, 66 are respectively between 0.75 and 1.25 and 2.75 and 4.5 inches.

It is appreciated that the bedpan 20 can made with any combination of the above mentioned dimensions.

Figure 7:
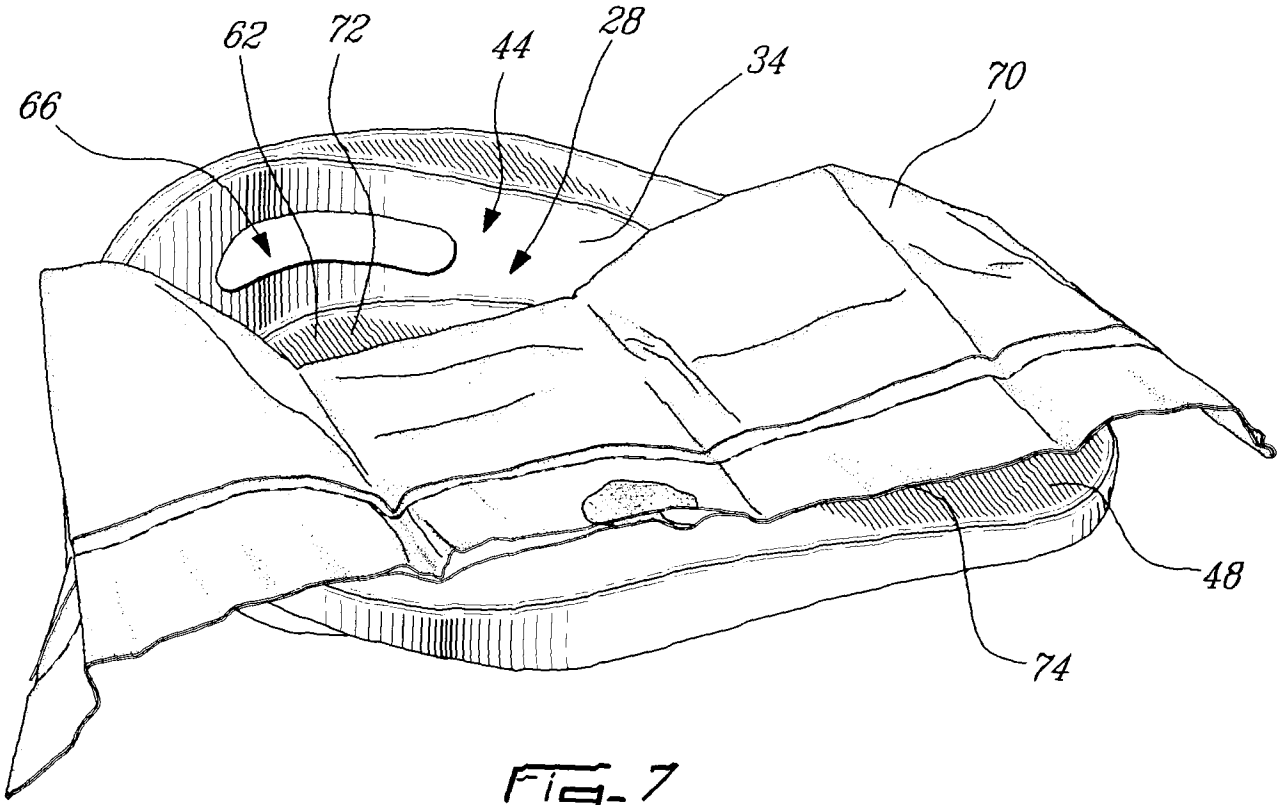
FIG. 7 is the bedpan of FIG. 1 provided with a folded bedpan liner extending over its top surface.
Figure 8:
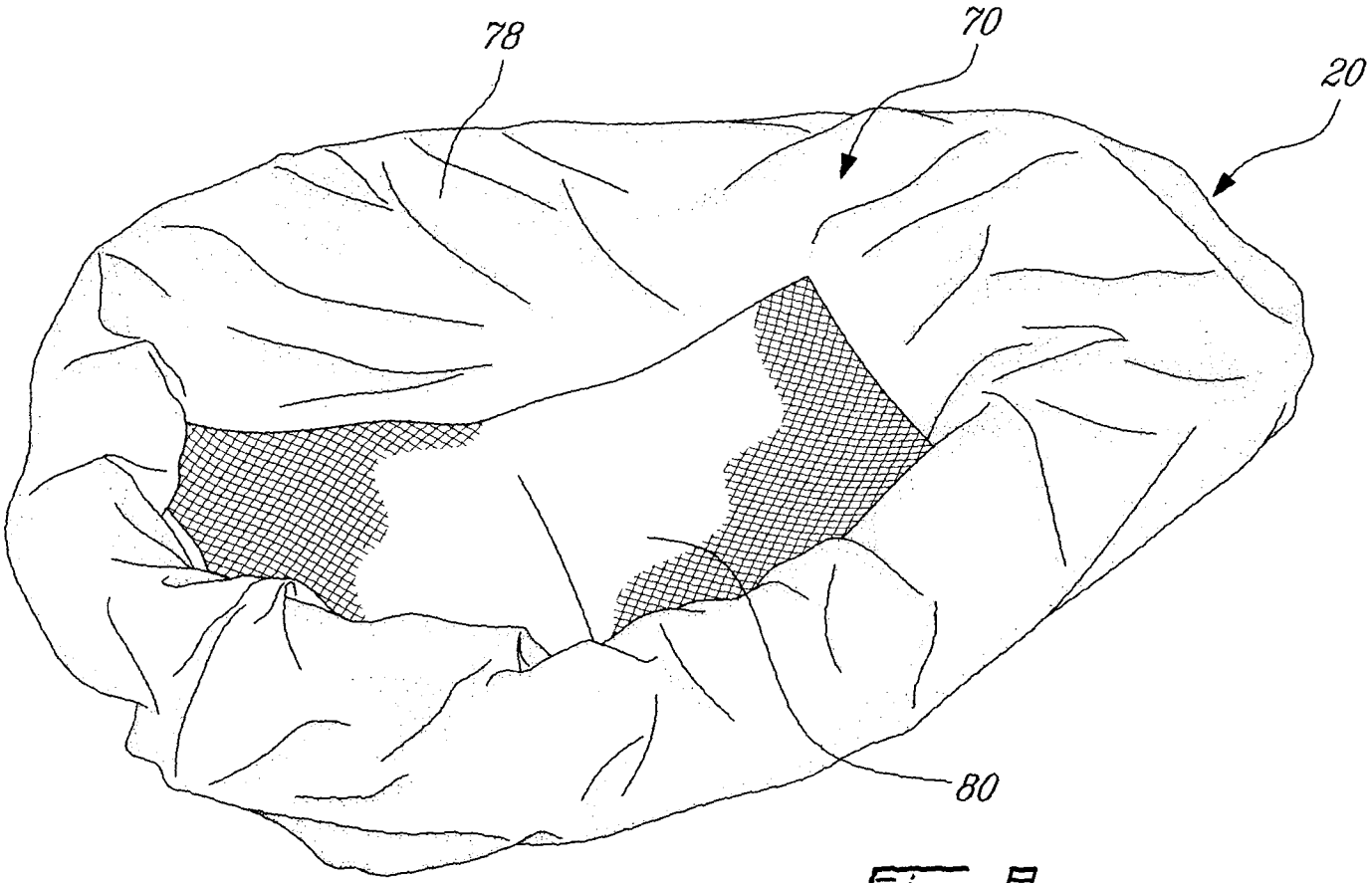
FIG. 8 is a top plan view of the unfolded bedpan liner of FIG. 7 wrapped around the bedpan shown in FIG. 1.
Figure 9:
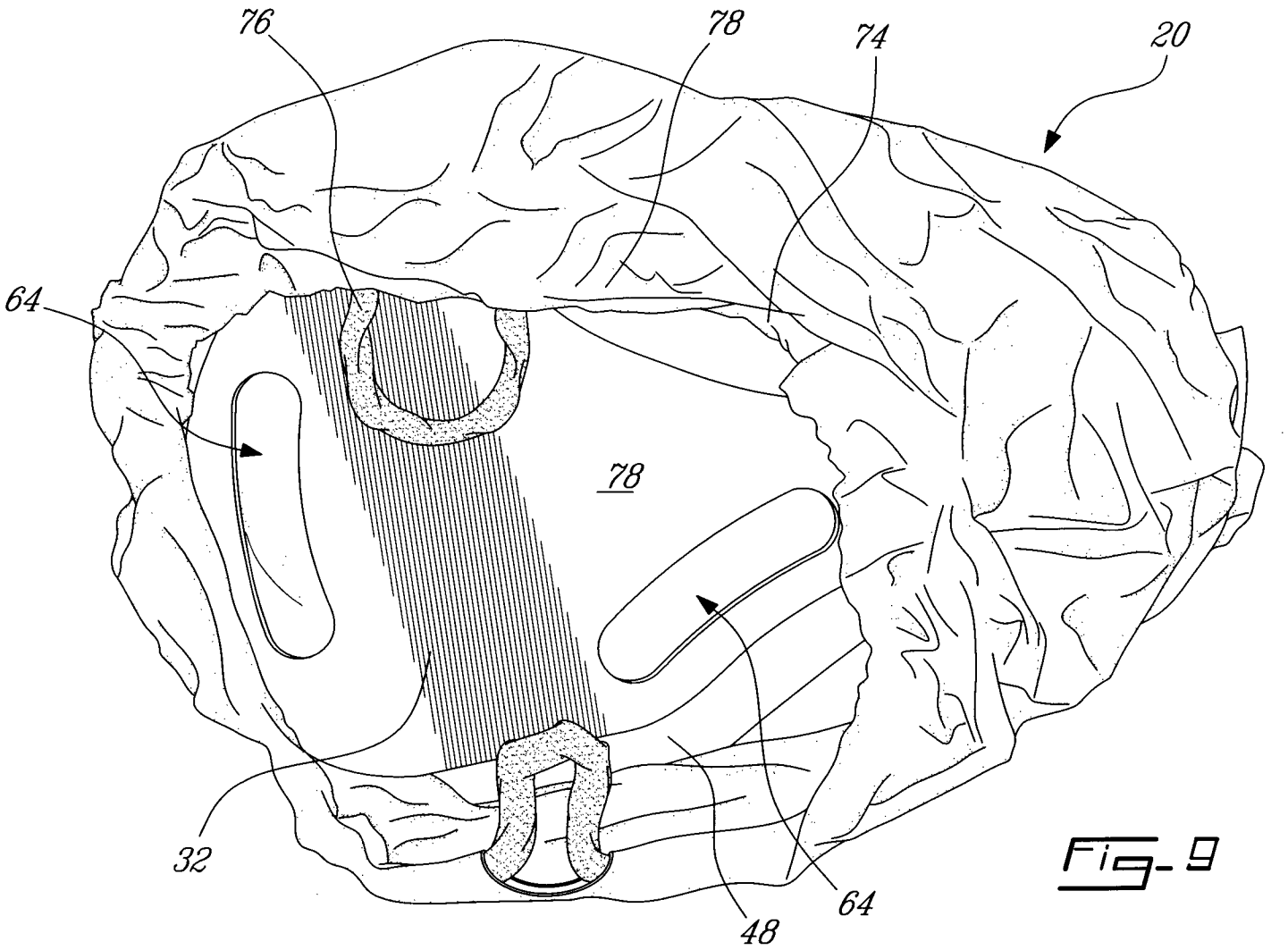
FIG. 9 is a bottom plan view of the unfolded bedpan liner of FIG. 7 wrapped around the bedpan shown in FIG. 1.

Referring now to FIGS. 7 to 9, there is shown that to hold human waste inside the cavity 44 despite the apertured handles 64, 66 defined in the bottom wall 62 and/or the peripheral wall 34, a disposable bedpan liner 70 is received in the cavity 44. In an embodiment, the bedpan liner 70 lines the inner face 72 of the receptacle portion 28. Bedpan liners, such as the one described in European patent No. 0 948 304, can be used.

In use, and as shown in FIG. 8 and FIG. 9, the bedpan liner 70 which has the shape of a bag lines simultaneously the seat member 30 and the inner face 72 of the receptacle portion 28. The upper edges 74 of the bag 70 are fitted tightly under the flange 48 for adjusting and securing the bedpan liner 70 to the bedpan 20. In an alternate embodiment, the upper edges 74 are tied under the receptacle portion 28.

In an embodiment, the bedpan liner 70 is sized and shaped to cover the whole receptable portion 28 and the horizontally extending section 50 of the seat member 30. It can also be secured to the bedpan 20 under the flange 48 or the receptacle portion 28 and simultaneously cover the vertically extending section 52 of the seat member 30. The bedpan liner 70 can be secured to the bedpan by tightening a rope 76 slidably mounted to the upper edges 74 of the bedpan liner 70. Alternatively, the bedpan liner 70 can include an elastic band (not shown) which secures the bedpan liner 70 by applying pressure to the outer face of the bedpan 20.

The bedpan liner 70 can be placed in the cavity 44 before inserting the bedpan 20 under the patient's buttocks. However, in an alternate embodiment, the bedpan liner 70 can be provided in the cavity 44 once the bedpan 20 is inserted beneath the patient's buttocks.

The bedpan liner 70 can include a layer 78 of a flexible and impermeable material such as, for instance, polyethylene, polypropylene, complex and non-woven polyethylene, resilient paper or waterproof batting. It can also be made of vinyl. It can be lined with a non-woven material in order to improve the patient's comfort.

In an embodiment, the bedpan liner further includes an absorbent material layer 80, such as a gel, which captures liquids. The absorbent material layer 80 substantially instantaneously holds liquids to ease handling. For example, neutralized, cured, and/or reticulated polyacrylate can be used. This absorbent material layer 80 can form an integral part of the liner 70 or can be provided separately and simply be placed on the liner 70.

The absorbent material layer 80 can be a distinct component from the layer 78 or it can be provided as a single-piece. For example, the gel agent can be in powder crystal or fiber form, spread out over or stuck to the bottom of the bag. It can be contained in a sachet which is placed or glued to the bottom of the bag. The bag can be made of a water soluble material or made of a material that is made fragile by the liquid so that it breaks upon contact with it (e.g. paper or cellulose wadding). Alternatively, the gel agent can be inserted into a non-woven device or glued to adhesive paper or simply glued to or placed at the bottom of the bag.

The gel agent can include products to improve comfort conditions. For example, it can include deodorants, antiseptics, virucides, antiretroviral, microbicides, bactericides, fungicides, or reagents, etc.

Insertion aperture 68 shown in FIG. 1 and provided on the bedpan 20 can be used to access the patient's buttocks to insert items such as medication in suppository format or fingers if an examination is required. It is typically not used as a handle. Its presence on the bedpan 20 is completely optional.

It will be readily understood that this insertion aperture 68 is useless in the embodiment shown in FIG. 8 and FIG. 9 when a liner 70 covers the whole bedpan 20 and receives the bodily waste. It can therefore be omitted from the bedpan design without departing from the invention.

Figure 10:
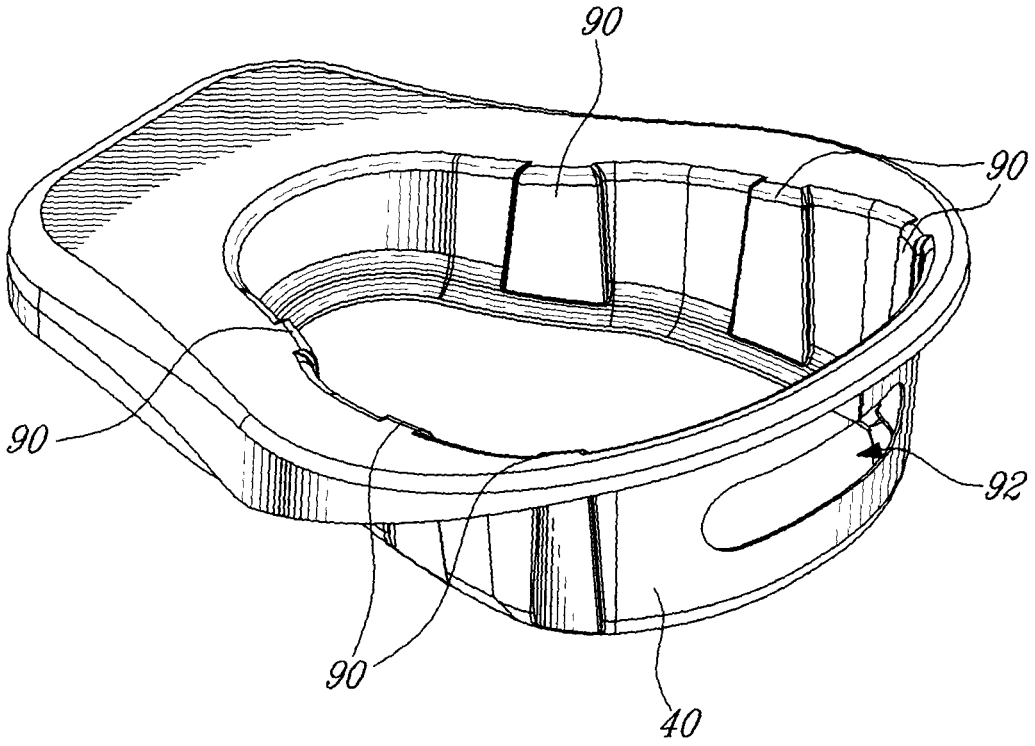
FIG. 10 is a perspective top view of another bedpan having an open bottom receptacle portion in accordance with another embodiment.

FIG. 10 shows an embodiment of the bedpan 20 in which the receptacle portion 28' of the bedpan 20 is bottomless and in which only the upright peripheral wall 34 of the receptacle portion 28' contains a handle. In the embodiment shown in FIG. 10, the wall 34 has two handles 66 defined therein and there is no handle defined in the bottom wall 32 of the receptacle since there is no bottom wall 32. This embodiment of the bedpan 20 requires use of a liner 70 such as the one shown and described in relation with FIGS. 7 to 9. Indeed, once the bedpan 20 is provided with the liner 70 and once the bedpan is placed under the patient's buttocks, the planar bottom wall 32 of the receptacle portion 28 of the embodiment of FIG. 1 becomes useless. At least one handle on the peripheral wall 34 is still useful to help the service provider place and remove the bedpan under the patient's buttocks.

This embodiment is particularly useful for use with obese patients who have a large quantity of soft tissues around the buttocks area which tend to accumulate in the receptacle portion of the bedpan and render correct use of the bedpan without spillage difficult. In this embodiment, the soft tissues can enter the receptacle portion and fall in without reaching a bottom wall and therefore are not accumulated in the receptacle portion. As will be readily understood, the liner 70 needs to be sufficiently sized to allow covering of the whole bedpan 20 while creating a receptacle-shaped space within the receptacle portion of the bedpan.

This bottomless bedpan of FIG. 10 can be manufactured by molding a bedpan of the type of FIG. 1 and cutting the planar bottom wall 32 off afterwards. Since the bedpan is preferably made of a recyclable plastic material, the bottom wall 32 so removed can be melted for reuse.

The bedpan receptacle can simply be considered to be a cylinder defined by the peripheral wall 34. The cylinder preferably has a substantially pear-shaped cross-section, that is the central opening of the vessel, and is therefore a pyriform cylinder. As will be readily understood, other cross-section shapes could be used if appropriate for use by the patient and for his comfort. The cylinder is either open-ended at its two extremities if the receptacle is bottomless as in the embodiment of FIG. 10 or closed at one end by the pear cross-section bottom wall 32.

The embodiments of the invention described above are intended to be exemplary only. The scope of the invention is therefore intended to be limited solely by the scope of the appended claims.

The invention claimed is:

1. A bedpan kit, comprising: a bedpan liner capable of holding human waste; a cylinder including a peripheral wall member with at least one apertured handle extending through the peripheral wall member for insertion and removal of the bedpan under a patient's buttocks, and a seat member extending outwardly from an upper edge of the peripheral wall member; wherein said bedpan liner is insertable in said cylinder to at least partially line said peripheral wall member and said seat member, thereby covering inwardly said apertured handle and holding said human waste received therein within said cylinder and said liner.

2. A bedpan kit as claimed in claim 1, wherein said cylinder has a bottom wall defined at a bottom cylinder edge for closing said cylinder into a reservoir.

3. A bedpan kit, comprising:

a rigid open top pan having a bottom wall and a surrounding peripheral wall, the bottom wall and the surrounding peripheral wall defining a cavity in the open top pan, at least one of the bottom wall and the surrounding peripheral wall including at least one apertured handle comprising a through hole extending through the at least one of said bottom wall and said peripheral wall for insertion and removal of the vessel under a patient's buttocks;

a seat member extending outwardly from the peripheral wall; and a bedpan liner insertable in the cavity, at least partially lining the bottom wall and the surrounding peripheral wall and configured to cover the at least one apertured handle and hold human waste received therein.

4. A bedpan kit as claimed in claim 3, wherein said at least one apertured handle is four apertured handles, three ones of said four apertured handles including a through hole extending through said bottom wall and one other one of said four apertured handles including a through hole extending through said peripheral wall.

5. A bedpan kit as claimed in claim 3, wherein said bedpan liner is a disposable liner.

6. A bedpan kit as claimed in claim 3, wherein said bedpan liner comprises a layer of a flexible and impermeable material.

7. A bedpan kit as claimed in claim 6, wherein said bedpan liner comprises an absorbent material layer.

8. A bedpan kit as claimed in claim 7, wherein said liner comprises a bag and said absorbent material layer is one of spread out over said bag, placed on said bag and affixed to said bag.

9. A bedpan comprising: a body member defining a receptacle portion, shaped and dimensioned for receiving a bedpan liner and bodily waste therein, and a seat member defining a central opening at least partially surrounding and providing access to the receptacle portion, the receptacle portion comprising a peripheral wall extending downwardly from the seat member and having at least one peripheral handle including an opening extending through the peripheral wall for insertion and removal of the bedpan under a patient's buttocks; and wherein the bedpan liner is engageable with the seat member when the liner is received in the receptacle portion.

10. The bedpan as claimed in claim 9, wherein the receptacle portion further comprises a bottom wall extending from a downward edge of the peripheral wall to close a bottom of the receptacle portion.

11. The bedpan as claimed in claim 10, wherein the bottom wall further comprises at least one bottom handle including an opening extending through said bottom wall for insertion and removal of the bedpan under a patient's buttocks.

12. The bedpan as claimed in claim 11, wherein said at least one peripheral handle is one peripheral handle and said at least one bottom handle is three bottom handles.

13. The bedpan as claimed in claim 9, wherein said bedpan liner is disposable.

14. A bedpan comprising:

a receptacle portion including a bottom wall and a peripheral wall extending upwardly from the bottom wall and defining therewith a reservoir shaped for receiving therein a bedpan liner; and a seat member defining a central opening providing access to the reservoir; and at least one handle for insertion and removal of the bedpan under a patient's buttocks, the handle including an opening extending through at least one of the bottom wall and the peripheral wall;

wherein said bedpan liner lines the reservoir when the liner is received by said receptacle portion.

15. A bedpan as claimed in claim 14, wherein said at least one handle is one handle and wherein said opening is an opening extending through said bottom wall.

16. A bedpan as claimed in claim 14, wherein said at least one handle is three handles, each said three handles including an opening extending through said bottom wall.

17. A bedpan as claimed in claim 14, wherein said at least one handle is two handles, each said two handles including an opening extending through said peripheral wall, partially facing one another near a rear of the bedpan.

18. A bottomless bedpan in combination with a bedpan liner, the bottomless bedpan comprising: a seat member and a peripheral wall member extending downwardly and inwardly from the seat member and defining a cavity therein, the peripheral wall member comprising at least one handle including a through hole extending through the peripheral wall member for insertion and removal of the bedpan under a patient's buttocks, the bedpan liner being insertable in the cavity and engageable with the seat member for holding human waste.

19. A bottomless bedpan as claimed in claim 18, wherein said bedpan liner is a disposable bedpan liner.

* * * * *

UNITED STATES PATENT AND TRADEMARK OFFICE

CERTIFICATE OF CORRECTION

PATENT NO. : 8,869,318 B2
APPLICATION NO. : 12/747417
DATED : October 28, 2014
INVENTOR(S) : Eric Tanguay It is certified that error appears in the above-identified patent and that said Letters Patent is hereby corrected as shown below:

In the Specification

Col. 2, line 26;

should be -- According to a second aspect of the invention, there is provided a bedpan comprising a body member defining a reservoir, the reservoir being shaped and dimensioned for receiving bodily waste, the body member including a receptacle portion shaped for receiving therein a bedpan liner and an open support section including a central opening providing access to the reservoir defined by the body member, the receptacle portion including a bottom wall and the support section being defined by a peripheral wall extending upwardly from a peripheral edge of the bottom wall, and at least one handle for insertion and removal of the bedpan under a patient's buttocks, the handle including an opening extending through at least one of the bottom wall and the peripheral wall, wherein the central opening of the reservoir is covered by the bedpan liner where the liner is received by the receptacle portion. --;

Col. 2, line 49;

should be -- According to a fourth aspect of the invention, there is provided a bedpan in combination with a bedpan liner, the bedpan comprising a vessel including a peripheral wall member and a bottom wall member, wherein the peripheral wall member and the bottom wall member are configured to define a cavity within the vessel for receiving the bedpan liner capable of holding human waste; and at least one handle for insertion and removal of the vessel under a patient's buttocks, the handle including a through hole extending through at least one of the peripheral wall member and the bottom wall member --;

Signed and Sealed this
Fourteenth Day of April, 2015

Michelle K. Lee

Michelle K. Lee
*Director of the United States Patent and Trademark Office*

Col. 3, line 49;

"another embodiment." should be -- another embodiment; --;

Col. 3, line 51;

"FIG. 5." should be -- FIG. 5; --; and

Col. 6, line 43;

"20 can made" should be -- can be made --.